US005407634A

United States Patent [19]

Martin et al.

[11] Patent Number: 5,407,634

[45] Date of Patent: Apr. 18, 1995

[54] GRAIN SIZE CONTROL OF METALLIC MATERIALS BY INERT GAS DOPING

[75] Inventors: Ricky L. Martin, St. Peters; Richard J. Lederich, Des Peres, both of Mo.

[73] Assignee: McDonnell Douglas Corporation, St. Louis, Mo.

[21] Appl. No.: 179,951

[22] Filed: Jan. 11, 1994

[51] Int. Cl.[6] ..... B22F 3/12

[52] U.S. Cl. ..... 419/57; 419/42; 75/228; 75/950

[58] Field of Search ..... 419/57, 42; 75/228, 75/950

[56] References Cited

PUBLICATIONS

Hausner et al, "Modern Developments in Powder Metallurgy," vol. 9, Metal Powders Industries Federation, 1977, pp. 525–536.

*Primary Examiner*—Donald P. Walsh
*Assistant Examiner*—Daniel Jenkins
*Attorney, Agent, or Firm*—Bell, Seltzer, Park & Gibson

[57] ABSTRACT

A method of inhibiting grain growth and restricting grain size during heat-treatment and hot-working of metallic materials. A small volume of inert gas is added to a metallic material so that the inert gas is dispersed throughout the metallic material. The metallic material is then heated sufficiently high so that the inert gas forms micropores within the metallic material; the micropores interact with grain boundaries to inhibit grain growth. If desired, all or part of the residual microporosity may be eliminated from the metallic material during the final step of a deformation processing cycle.

6 Claims, 1 Drawing Sheet

GRAIN SIZE CONTROL OF METALLIC MATERIALS BY INERT GAS DOPING

BACKGROUND OF THE INVENTION

This invention pertains generally to metallic materials, and, more particularly, to a method for inhibiting grain growth and restricting grain size during heat-treatment and hot-working of metallic materials. As used herein, the term "metallic material" includes pure metals, metal alloys, and intermetallic alloys among others.

Annealing and deformation processing of metallic materials at high temperature can provide unique phase morphologies by solutioning primary phases and controlling their precipitation upon cooling. In addition, increasing the temperature at which a specific metallic material is processed can reduce forming power requirements since material formability is increased. However, exposure of metallic materials to high temperatures results, in many cases, in deleterious grain growth. Although a coarse grain structure is desirable from a fracture behavior and high temperature strength standpoint, a large grain size in the final product can negate desirable phase morphologies and dominate mechanical behavior by causing poor fatigue resistance and low room temperature strength and ductility. Using lower temperatures to prevent deleterious grain growth results in higher power requirements for processing equipment due to the reduced formability of metals. At these lower temperatures, processing time is extended because lighter passes must be taken, and more intermediate workpiece conditioning is required because the occurrence of surface-cracking is increased.

The current method for inhibiting grain growth during heat-treatment and hot-working of metallic materials is to establish low solubility dispersoids or precipitates in the metallic matrix. The dispersoids have good thermal stability so they resist dissolution in the matrix during extended high temperature exposure. Dispersoids can be introduced into the matrix by traditional alloying during ingot melting operations, or by solid state powder metallurgy processes such as mechanical alloying. At elevated temperatures, these incoherent dispersoids interact with grain boundaries to prevent grain boundary movement and corresponding grain growth. In many alloy systems, when thermally stable dispersoids are not possible for grain boundary control, matrix precipitates are employed to inhibit grain boundary movement during thermal exposure. In either case, however, processing and heat-treatment ,are limited to temperatures where sufficient thermal stability of the dispersoids or precipitates exist. As temperatures approach the solvus of the dispersoids or precipitates, and the matrix diffusivity of their constituent elements increase, the dispersoids or precipitates will coarsen, coalesce, and/or dissolve into the matrix. For example, alpha-beta titanium alloy Ti-6 wt % Al-4 wt % V (Ti-6-4) component workpieces are processed and heat-treated at least 50° F. below the alloy's beta transus (1820° F.) to allow primary alpha precipitates to remain present in the matrix at peak temperatures to inhibit the growth of beta grains. Heating above the alloy's beta transus will result in solutioning of primary alpha particles, allowing unrestricted growth of beta grains. Accordingly, line grain size is currently preserved by heating and processing just below the solvus of a secondary phase.

There is therefore a need in the art for a method of maintaining a fine grain size during heat-treatment and processing of metallic materials at extremely high temperatures.

SUMMARY OF THE INVENTION

The method of the present invention includes introducing a small volume of inert gas to a metallic material during initial production so that the inert gas is dispersed throughout the metallic matrix. The metallic matrix is then heated sufficiently high so that the inert gas forms micropores within the matrix. These micropores interact with grain boundaries to inhibit grain growth. If desired, all or part of the residual microporosity may be eliminated from the metallic material during the final step of a deformation processing cycle.

The method of inert gas doping disclosed herein inhibits grain growth during heat-treatment and hot-working of metallic materials and allows high temperature heat-treatment of metallic materials above the solvus of secondary phases without deleterious grain growth. This increased processing and heat-treatment flexibility beyond what is possible with conventional dispersoids and precipitates allows increased workpiece formability and therefore reduced power requirements and increased production rates. The method also offers advantages in microstructure/property relationships by eliminating the need for gain control compounds and allowing phase morphologies not possible with conventional alloying, processing, and heat-treatment methods.

The present invention provides a number of advantages over the utilization of precipitates and dispersoids for grain control in metals. First, precipitates and dispersoids can coarsen and/or dissolve at temperatures far below the melting point of metals, whereas microporosity from inert gas additions become more stable as temperature increases. Second, precipitates and dispersoids remain present in the final product and can have a negative impact on fatigue properties, ductility, toughness, etc., whereas microporosity, after processing and heat-treatment, can be eliminated to avoid effects on material mechanical properties during service. Third, precipitates and dispersoids are created through reactions and can cause reactions with the metallic matrix which can affect phase chemistry, morphology, etc., whereas inert gas doping involves no chemical-solid-state reactions with the base metal, so that matrix phase and microstructure relationships are unaffected.

BRIEF DESCRIPTION OF THE DRAWINGS

Other objects, features, and advantages of the present invention will become more fully apparent from the following detailed description of tile preferred embodiment, the appended claims, and the accompanying FIG. 1 which is a macrophotograph (2X) of three beta annealed Ti-6-4 samples prepared according to Example 1 herein.

DETAILED DESCRIPTION OF THE PREFERRED EMBODIMENT

Figures 1A, 1B, 1C:
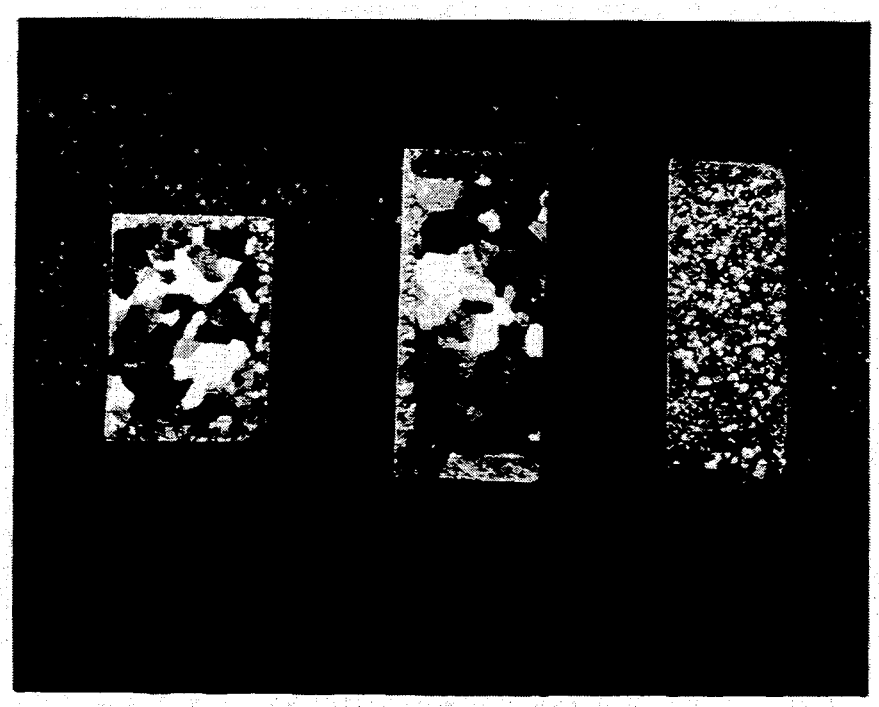

Grain boundary control is achieved according to the present invention by introducing a small volume of inert gas to tile metallic material during initial production in a manner that creates pockets of inert gas dispersed throughout the metallic matrix. The inert gas addition allows subsequent formation of micropores that are effective in inhibiting grain growth in the metallic material during heat-treatment, hot-working operations, and high temperature service. Any suitable means may be employed to introduce the inert gas, including: 1 ) backfilling the inert gas into a can or any closed container containing metallic powder prior to consolidating tile powder to a solid billet, 2) atomizing molten metallic material into solidified metallic powder using inert gas jets, or within an inert gas chamber, using parameters that trap tile gas within individual powder particles, 3) adding the inert gas to a melt prior to casting the molten metal into ingot form, 4) mixing a solid substance with metallic powder that will produce an inert gaseous product during subsequent high temperature exposure, or 5) mixing a solid substance into a melt that will produce an inert gaseous product in the melt or in the solidified ingot alter pouring the molten metallic material into the mold.

As the metallic material product is heated, the small volume of trapped gas dispersed throughout the matrix expands to form micropores within the matrix. To cause microporosity to form, the exposure temperature must be sufficiently high so that the internal gas pressure within each gas pocket exceeds the metallic material flow strength of the surrounding matrix. As temperature is increased, trapped gas pressure increases and matrix flow strength decreases. The cross-over temperature where micropores form and grow is typically well below temperatures where significant grain growth in specific metallic material systems will occur. During subsequent heat-treatment and hot deformation processing, the presence of matrix micropores interact with grain boundaries to prevent grain boundary movement and corresponding grain growth.

The size, spacing, and volume of micropores in the metallic matrix will have an impact on the level of grain refinement in a fully processed and heat-treated component; these microporosity features may be manipulated by the volume of gas originally introduced, the method of introduction, the initial product form of the metallic material (e.g., metal powder size fraction), and the subsequent heat-treatment or furnace soaking to which the product is exposed. For example, prior to isostatic pressurization to produce a solid product, a can containing 44 micron diameter Ti-6-4 powder particles can be vacuum evacuated and backfilled with a 0.5 atmosphere pressure level of inert gas. Subsequent heat-treatment at an extremely high temperature such as 2200° F. will cause formation of approximately 5 volume percent micropores throughout the Ti-6-4 matrix. This will restrict grain size to a maximum upper limit of 44 micron diameter (original particle size) during heat-treatment, hot-working operations, and high temperature service. In another example, a can containing Ti-6-4 powder particles ranging from 44 to 420 microns in diameter can be evacuated and backfilled with 0.1 atmospheres of inert gas and sealed. Heat-treatment at a more moderate temperature such as 1950° F. will cause formation of approximately 1 volume percent micropores throughout the Ti-6-4 matrix. This will sufficiently inhibit grain growth during later deformation processing above the beta transus to produce a typical grain size of 500 microns in a manufactured component.

Subsequent hot deformation processing may temporarily close and heal the microporosity resulting from the disclosed method; however, if the temperature is maintained during the operation, pores will reopen as deforming forces are removed between passes. Also, intermediate furnace soaking cycles prior to continued hot-working will re-establish microporosity closed during the final pass before soaking. Therefore, standard production hot-working operations that use multiple deformation passes and furnace reheats will not allow grain growth since formation of microporosity will persist throughout all steps. Metal undergoing static heat-treatment cycles will also remain protected from grain growth throughout the entire cycle due to the constant presence of microporosity.

All or part of the residual microporosity can be eliminated from the metallic material during the final step of a deformation processing cycle. Any suitable means, e.g., isostatic pressurization, can be employed to eliminate residual microporosity from hot-worked and/or heat-treated fine-grained material. Since primary hot-working operations may be accomplished with large volumes of metal, (e.g., billet stock, large rectangular and round bar), it may be more feasible to perform the microporosity elimination step using isostatic pressurization after sectioning to rough component sizes. Hot isostatic pressing (HIP) operations are an effective method for eliminating microporosity. HIP is often used to close and heal shrinkage and gas porosity present in metal castings. Care is taken to select parameters that preserve the tine grain size of the component while completely closing and healing micropores. For example, Ti-6-4 material containing micropores can be given a HIP cycle at 1650° F. under 15 ksi pressure. At 1650° F., rapid grain growth will not occur in conventional Ti-6-4 (without inert gas doping), yet matrix flow strength is low enough to cause micropores to collapse and heal. Therefore, the micropores will be eliminated while preserving the fine grain size of the Ti-6-4 material. In some cases, final applications may dictate that a HIP step is unnecessary because the size and volume of micropores may not have a significant impact on mechanical properties. The use of the HIP step for inert gas doped/fine-grained metal will be dictated by the level of microporosity after heat-treatment and processing and the final application requirements.

Typical service temperatures for metallic components fabricated by the method of the present invention are hr below tile cross-over temperature where micropores begin to form and grow from trapped gas in the matrix. This is an important feature since the intent of the inert gas doping is to control grain structure during heat-treatment and processing, yet remain benign when the final components are in service. In some high temperature applications, service temperatures may exceed the cross-over temperature where micropores begin to form and grow from trapped gas in the matrix. In these cases, micropores will remain stable in the metallic material to prevent grain growth during service. This behavior can be desirable in non-structural applications where component life is limited by grain growth (e.g., reactor tubes).

The invention will be further clarified by consideration of the following examples, which are intended to be purely exemplary of the use of the invention.

EXAMPLE 1

Three Ti-6-4 samples were simultaneously exposed to a high temperature (1950° F.) beta anneal cycle for 24 hours. All samples had similar starting grain sizes prior to this thermal exposure. Sample 1 was a wrought ingot-metallurgy Ti-6-4 coupon cut from a standard Ti-6-4 mill plate section produced from ingot. Sample 2 was a consolidated powder metallurgy plasma rotating electrode powder (PREP) Ti-6-4 coupon and sample 3 was a consolidated powder metallurgy PREP Ti-6-4 coupon that had been doped with inert gas (0.1 atmospheres backfilled argon). Samples 2 and 3 were made by placing PREP Ti-6-4 powder into a pressure tight can, followed by hot vacuum outgassing. Sample 2 was sealed under a vacuum to simulate the standard practice used for production Ti-6-4 powder metallurgy components. In sample 3, 0.1 atmospheres pressure of argon gas was backfilled into tile can prior to sealing. Both samples 2 and 3 were consolidated to 100% theoretical density using a HIP cycle of 1650° F./15 ksi/2 hours. Sample 2 contained no trapped gas while sample 3 contained a small amount of trapped gas due to the backfilling step prior to sealing the canning and HIPing. To illustrate the effect of inert gas doping on grain growth, the three samples were then given the long term beta anneal cycle. The long term beta anneal cycle resulted in coarse grain sizes in control samples 1 and 2, shown in FIG. 1*a* and 1*b*, respectively. Sample 3, shown in FIG. 1*c*, retained the fine-grained beta structure that was present prior to heat-treatment; thus, the presence of a trace amount of inert gas resulted in microporosity in sample 3 that interacted with grain boundaries to inhibit grain growth during heat treatment.

EXAMPLE 2

Two samples were employed in this example: sample 1 was a conventionally processed Ti-6-4 plate made from ingot. Sample 2 was a Ti-6-4 plate produced by backfilling 0.1 atmospheres pressure of argon gas into a can containing Ti-6-4 powder metal; the can was sealed and the Ti-6-4 metal powder was consolidated by HIPing at 1650° F. under 15 ksi pressure and held for 2 hours. To simulate high temperature exposure during hot-working and beta heat-treatment, the two samples were annealed at 2000° F. for 24 hours and then air cooled. Both samples were then hot isostatically pressed at 1650° F. under 15 ksi pressure and held for 2 hours. The samples were cooled to 1550° F. while still under pressure and held for another 2 hours; they were then furnace cooled to room temperature at atmospheric pressure. As a result of the HIP cycle, micropores were eliminated in sample 2.

The tensile properties of each sample were measured to determine the effect of inhibiting grain growth in sample 2. For sample 1, ultimate tensile strength was 127 ksi, yield strength was 112 ksi, and elongation was 9%; for sample 2, ultimate tensile strength was 140 ksi, yield strength was 128 ksi, and elongation was 15%. This comparison of tensile properties demonstrated that doping the titanium alloy with inert gas prior to thermal exposure prevented deleterious grain growth during tile high temperature furnace soaking such that high strength properties and ductility were maintained.

Changes and modifications in the specifically described embodiments can be carried out without departing from the scope of the present invention which is intended to be limited only by the scope of the appended claims.

We claim:

1. A method of inhibiting grain growth in a metallic material having a predetermined metallic material flow strength, the method comprising the steps of:

(a) adding an inert noble gas to the metallic material so that the inert gas is dispersed throughout the metallic material wherein said adding step comprises a step of mixing a solid substance with metallic powder; and (b) heating the metallic material to a temperature sufficiently high so that the internal pressure of the inert gas exceeds the predetermined metallic material flow strength of the surrounding metallic material to thereby form micropores within the metallic material.

2. The method as recited in claim 1, further comprising the step of eliminating the micropores in the metallic material after said heating step.

3. The method as recited in claim 2, wherein said eliminating step comprises the step of applying isostatic pressurization to the metallic material.

4. A method of inhibiting grain growth in a metallic material having a predetermined metallic material flow strength, the method comprising the steps of:

(a) adding an inert noble gas to the metallic material so that the inert gas is dispersed throughout the metallic material, wherein said adding step comprises the steps of:

(1) backfilling the inert gas into a closed container containing metallic powder; and (2) consolidating the powder having the inert gas added thereto a solid billet;

(b) heating the metallic material to a temperature sufficiently high so that the internal pressure of the inert gas exceeds the predetermined metallic material flow strength of the surrounding metallic material to thereby form micropores within the metallic material; and (c) eliminating the micropores in the metallic material after said heating step by applying isostatic pressurization to the metallic material.

5. The method as recited in claim 4, wherein said eliminating step comprises the step of hot isostatic pressign of the metallic material.

6. A metallic material characterized by a grain size and having a predetermined metallic material flow strength, the metallic material prepared by a process comprising the steps of:

(a) adding an inert noble gas to the metallic material so that the inert gas is dispersed throughout the metallic material; wherein said adding step comprises the steps of:

(1) backfilling the inert gas into a closed container containing metallic powder; and (2) consolidating the powder having the inert gas added thereto a solid billet; and (b) heating the metallic material to a temperature sufficiently high so that the internal pressure of the inert gas exceeds the predetermined metallic material flow strength of the surrounding metallic material to thereby form micropores with the metallic material.

* * * * *

UNITED STATES PATENT AND TRADEMARK OFFICE

CERTIFICATE OF CORRECTION

PATENT NO. : 5,407,634

DATED : April 18, 1995

INVENTOR(S) : Ricky L. Martin and Richard J. Lederich

It is certified that error appears in the above-identified patent and that said Letters Patent is hereby corrected as shown below:

On title page, item [56]:

References Cited, PUBLICATIONS, Second column, line 1, "Powders" should be -- Powder --.

Column 1, line 53, before "are" omit the comma (,).

Column 1, line 68, "line" should be -- fine --.

Column 2, line 30, "gain" should be -- grain --.

Column 2, line 55, "tile" should be -- the --.

Column 2, line 65, "tile" should be -- the --.

Column 3, line 6, "tile" should be -- the --.

Column 3, line 10, "tile" should be -- the --.

Column 4, line 26, "tine" should be -- fine --.

Column 4, line 44, "hr" should be -- far -- and "tile" should be -- the --.

Column 5, line 9, after "production" insert -- of --.

Column 5, line 11, "tile" should be -- the --.

Column 5, line 54, "tile" should be -- the --.

UNITED STATES PATENT AND TRADEMARK OFFICE
CERTIFICATE OF CORRECTION

PATENT NO. : 5,407,634

DATED : April 18, 1995

INVENTOR(S) : Ricky L. Martin and Richard J. Lederich

It is certified that error appears in the above-identified patent and that said Letters Patent is hereby corrected as shown below:

Column 6, line 7, after "with" insert -- a --.

Column 6, line 31, after "thereto" insert -- into --.

Column 6, line 43, "pressign" should be -- pressing --.

Column 6, line 55, after "thereto" insert -- into --.

Column 6, line 60, "with" should be -- within --.

Signed and Sealed this

Eighteenth Day of July, 1995

*Attest:*

Bruce Lehman

BRUCE LEHMAN

*Attesting Officer*

*Commissioner of Patents and Trademarks*